US006645053B1

(12) United States Patent
Kimura et al.

(10) Patent No.: US 6,645,053 B1
(45) Date of Patent: Nov. 11, 2003

(54) POLISHING APPARATUS

(75) Inventors: Norio Kimura, Fujisawa (JP); You Ishii, Yokohama (JP); Yoshikuni Tateyama, Hiratsuka (JP)

(73) Assignees: Ebara Corporation, Tokyo (JP); Kabushiki Kaisha Toshiba, Kanagawa (JP)

( * ) Notice: Subject to any disclaimer, the term of this patent is extended or adjusted under 35 U.S.C. 154(b) by 0 days.

(21) Appl. No.: 09/622,638

(22) PCT Filed: Mar. 26, 1999

(86) PCT No.: PCT/JP99/01543

§ 371 (c)(1),
(2), (4) Date: Nov. 8, 2000

(87) PCT Pub. No.: WO99/50024

PCT Pub. Date: Oct. 7, 1999

(30) Foreign Application Priority Data

Mar. 26, 1998 (JP) ..... 10-96971

(51) Int. Cl.[7] ..... B24B 1/00

(52) U.S. Cl. ..... 451/56; 451/38; 451/57; 451/72; 451/286; 451/288

(58) Field of Search ..... 451/38, 56, 57, 451/72, 286, 288, 443

(56) References Cited

U.S. PATENT DOCUMENTS 4,680,893 A 7/1987 Cronkhite et al.
5,154,021 A 10/1992 Bombardier et al.
5,421,768 A 6/1995 Fujiwara et al.
5,690,544 A 11/1997 Sakurai
5,716,264 A 2/1998 Kimura et al.
5,916,010 A * 6/1999 Varian et al. ..... 451/287
6,135,868 A * 10/2000 Brown et al. ..... 451/443

FOREIGN PATENT DOCUMENTS

| | | |
|---|---|---|
| EP | 0 754 525 | 1/1997 |
| EP | 0 816 017 | 1/1998 |
| JP | 62-68273 | 3/1987 |
| JP | 3-10769 | 1/1991 |
| JP | 7-9340 | 1/1995 |
| JP | 9-29619 | 2/1997 |
| JP | 9-309063 | 2/1997 |
| JP | 2628915 | 4/1997 |

* cited by examiner

*Primary Examiner*—Joseph J. Hail, III
*Assistant Examiner*—Alvin J Grant
(74) *Attorney, Agent, or Firm*—Wenderoth, Lind & Ponack, L.L.P.

(57) ABSTRACT

A polishing apparatus has a turntable with a polishing cloth attached thereto and a top ring for holding and pressing a workpiece to be polished against the polishing cloth under a certain pressure. The polishing apparatus also has a first dressing unit having a contact-type dresser for dressing the polishing cloth by bringing the contact-type dresser in contact with the polishing cloth, and a second dressing unit having a noncontact-type dresser for dressing the polishing cloth with a fluid jet applied therefrom to the polishing cloth. The contact-type dresser comprises a diamond dresser or an SiC dresser.

11 Claims, 4 Drawing Sheets

POLISHING APPARATUS

TECHNICAL FIELD

The present invention relates to a polishing apparatus for polishing a workpiece such as a semiconductor wafer to a planar finish, especially a device pattern on the surface of the semiconductor wafer by bring the surface of the semiconductor wafer in contact with a polishing cloth, and particularly to a method of conditioning the surface of a polishing cloth attached to a turntable in the polishing apparatus.

BACKGROUND ART

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus, and such a process is called Chemical Mechanical Polishing (CMP) in which the semiconductor wafers are chemically and mechanically polished while supplying an abrasive liquid comprising abrasive grains and chemical solution such as alkaline solution.

In the polishing apparatus for polishing the surface of a semiconductor wafer, especially a device pattern on the upper surface of a semiconductor wafer, to a planar finish, as a polishing cloth attached to a turntable, a nonwoven fabric polishing cloth has heretofore been employed.

Higher levels of integration achieved in recent years for ICs and LSI circuits demand smaller steps or surface irregularities on the polished surface of the semiconductor wafer. In order to meet such a demand, it has been proposed to employ a polishing cloth made of a hard material such as polyurethane foam.

After the semiconductor wafers are contacted with the polishing cloth and polished by rotating the turntable and the top ring which holds the semiconductor wafer, the polishing capability of the polishing cloth is gradually deteriorated due to a deposit of abrasive grains and ground-off particles of the semiconductor material, and due to changes in the characteristics of the polishing cloth. Therefore, if the same polishing cloth is used to repeatedly polish semiconductor wafers, the polishing rate of the polishing apparatus is lowered, and the polished semiconductor wafers tend to suffer polishing irregularities. Therefore, it has been customary to condition the polishing cloth according to a process called "dressing" for recovering the surface of the polishing cloth before, or after, or during polishing.

There are basically two types of dressing processes, one of which is a contact-type dressing process in which a brush or a diamond dresser is brought into contact with a polishing cloth and rubs the polishing cloth, and the other of which is a noncontact-type dressing process in which a fluid jet of water or gas is applied under high pressure to the surface of the polishing cloth.

In the conventional polishing apparatus, either a dressing unit comprising a brush or a diamond dresser or a dressing unit employing a fluid jet has been incorporated therein, depending on the properties of a polishing cloth.

It has been found that when a new polishing cloth starts to be used, it needs to be dressed by a brush or a diamond dresser for initial conditioning, and while the polishing cloth is being used in a polishing process, it needs to be dressed by a fluid jet to remove an aggregate of abrasive slurry or ground-off particles of the semiconductor material therefrom. Unless the polishing cloth is dressed by the fluid jet, the polished surface of the semiconductor wafer is liable to be scratched, resulting in a poor yield of properly polished semiconductor wafers. For the above reasons, these two dressing units are required to be replaced with each other, when necessary, in the conventional polishing apparatus. Such a selective installing and replacing work has been tedious and time-consuming, and is liable to lower the throughput of the semiconductor wafers.

DISCLOSURE OF INVENTION

It is therefore an object of the present invention to provide a polishing apparatus which incorporates both a contact-type dressing unit having a brush or a diamond dresser and a noncontact-type dressing unit employing a fluid jet.

Another object of the present invention is to provide a method of conditioning the surface of a polishing cloth attached to a turntable in such a polishing apparatus.

According to one aspect of the present invention, there is provided a polishing apparatus comprising: a turntable with a polishing cloth attached thereto; a top ring for holding and pressing a workpiece to be polished against the polishing cloth under a certain pressure; a first dressing unit having a contact-type dresser for dressing the polishing cloth by bringing the contact-type dresser in contact with the polishing cloth; and a second dressing unit having a noncontact-type dresser for dressing the polishing cloth with a fluid jet applied thereto.

According to another aspect of the present invention, there is provided a method of conditioning a polishing cloth attached to a turntable for polishing a workpiece, comprising: dressing the polishing cloth with a first dressing unit having a contact-type dresser as initial conditioning when the polishing cloth starts to be used; and dressing the polishing cloth with a second dressing unit having a noncontact-type dresser between polishing processes, each for polishing the workpiece.

According to still another aspect of the present invention, there is provided a method of conditioning a polishing cloth attached to a turntable for polishing a workpiece, comprising: dressing the polishing cloth with a first dressing unit having a contact-type dresser as initial conditioning when the polishing cloth starts to be used; and dressing the polishing cloth first with the first dressing unit and then with a second dressing unit having a noncontact-type dresser between polishing processes, each for polishing the workpiece.

The polishing apparatus is equipped with both the contact-type dressing unit such as a diamond dresser and the noncontact-type dressing unit such as a fluid jet dresser. Therefore, it is not necessary to replace these contact-type and noncontact-type dressing units with each other on the polishing apparatus, but the contact-type and noncontact-type dressing units may be combined to carry out a desired pattern of dressing processes to dress or condition the polishing cloth.

The above and other objects, features, and advantages of the present invention will become apparent from the following description when taken in conjunction with the accompanying drawings which illustrate a preferred embodiment of the present invention by way of example.

BEST MODE FOR CARRYING OUT THE INVENTION

Next, a polishing apparatus according to the present invention will be described with reference to drawings.

Figure 1:
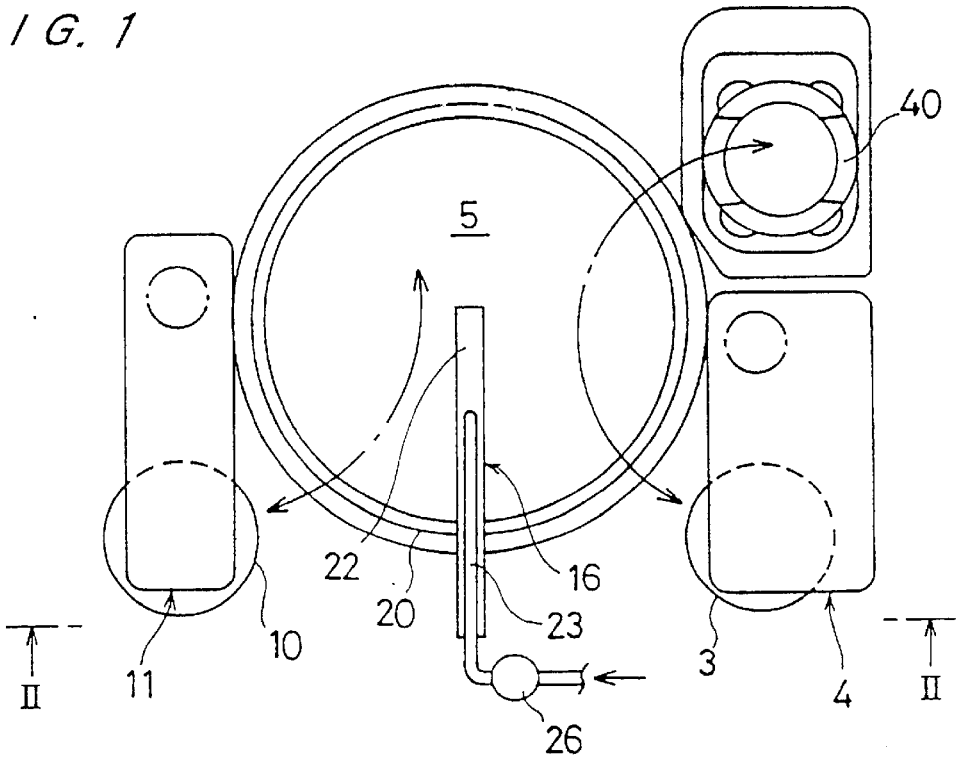
FIG. 1 is a plan view of a polishing apparatus according to the present invention.
Figure 2:
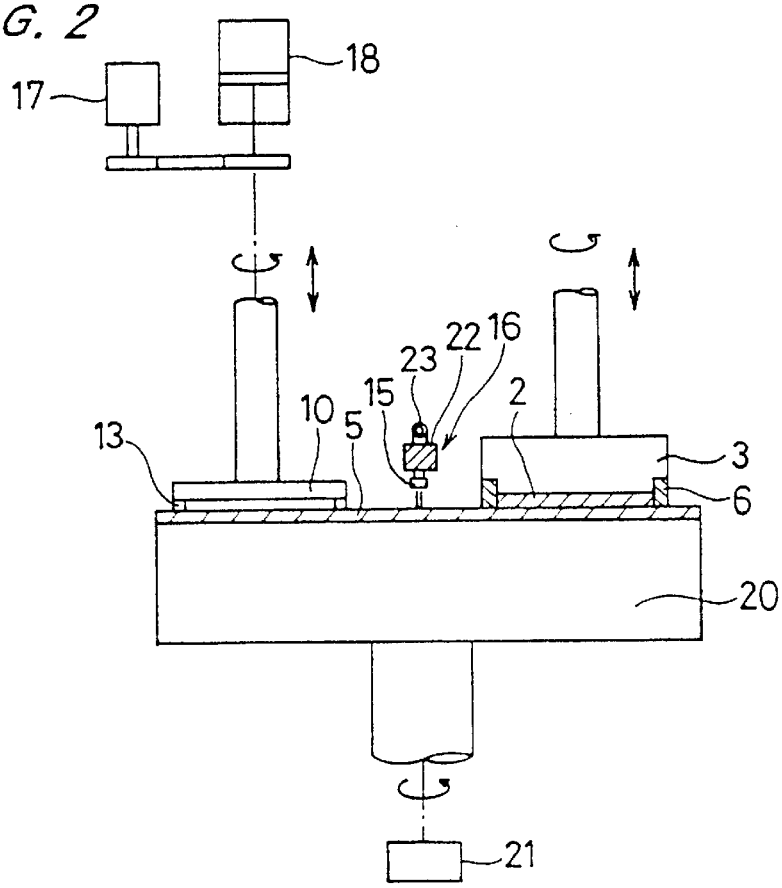
FIG. 2 is an elevational view, partly in cross section, taken along line II—II of FIG. 1.

As shown in FIGS. 1 and 2, a polishing apparatus according to the present invention comprises a turntable 20 and a top ring unit 4 having a top ring 3 for holding a semiconductor wafer 2 to be polished and pressing the semiconductor wafer 2 against the turntable 20. The turntable 20 is coupled to a motor 21 by a vertical shaft, and rotatable about the vertical shaft. A polishing cloth 5, such as IC-1000 manufactured by Rodel, Inc., is attached to the upper surface of the turntable 20.

A pusher 40 is positioned on one side of the turntable 20 adjacent to the top ring unit 4. The top ring unit 4 is angularly movable in a horizontal plane to move the top ring 3 between a transfer position above the pusher 40 where the semiconductor wafer 2 is transferred to and from the pusher 40, a polishing position over the turntable 20, and a standby position off the turntable 20. The top ring 3 is coupled to a motor and a lifting/lowering cylinder (not shown). The top ring 3 is vertically movable by the lifting/lowering cylinder and is also rotatable about its own axis by the motor as indicated by the arrows (see FIG. 2). When the top ring 3 is lowered toward the turntable 20, the top ring 3 presses the semiconductor wafer 2 against the polishing cloth 5 on the turntable 20 under a predetermined pressure. The top ring 3 has a holding mechanism (not shown) for holding the semiconductor wafer 2 by its lower surface under a vacuum. A guide ring 6 is mounted on a lower outer circumferential surface of the top ring 3, whereby the semiconductor wafer 2 is retained against removal from the lower surface of the top ring 3. An abrasive liquid containing abrasive grains is supplied to the polishing cloth 5 on the turntable 20 by an abrasive liquid supply nozzle (not shown) which is positioned above the turntable 20.

The polishing apparatus also has a first dressing unit 11 having a contact-type dresser 10, and a second dressing unit 16 having a noncontact-type dresser comprising a plurality of water jet nozzles 15. The first dressing unit 11, which is positioned diametrically opposite to the top ring unit 4 and the pusher 40 across the turntable 20, is angularly movable in a horizontal plane between a dressing position over the turntable 20 and a standby position off the turntable 20. As shown in FIG. 2, the dresser 10 is connected to a motor 17 and a lifting/lowering cylinder 18. The dresser 10 is vertically movable by the lifting/lowering cylinder 18 and is also rotatable about its own axis by the motor 17 as indicated by the arrows (see FIG. 2).

Figure 3A:
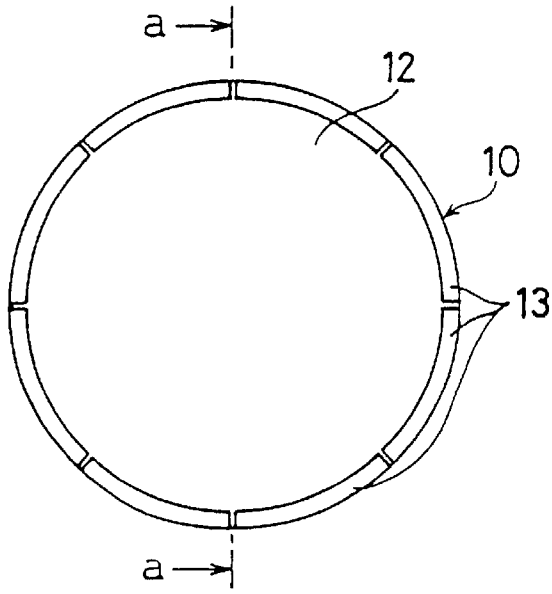
FIG. 3A is a bottom view of a diamond dresser in a first dressing unit incorporated in the polishing apparatus.
Figure 3B:
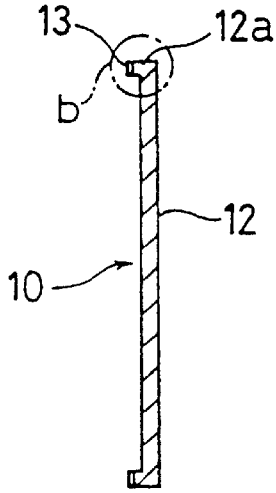
FIG. 3B is a cross-sectional view taken along line a—a of FIG. 3A.
Figure 3C:
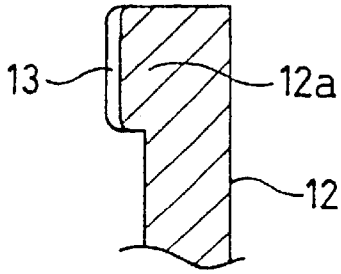
FIG. 3C is an enlarged view of an encircled area b in FIG. 3B.

FIGS. 3A, 3B, and 3C show in detail the dresser 10 of the first dressing unit 11. As shown in FIGS. 3A, 3B and 3C, the dresser 10 comprises a circular disk-shaped dresser body 12 having an annular projection 12*a* extending along a lower circumferential edge thereof and having a predetermined radial width. The dresser 10 will also be referred to as a diamond dresser 10. The dresser 10 has an electrodeposited diamond ring 13 which comprises fine grains of diamond electrodeposited on the lower surface of the annular projection 12*a*. Specifically, the electrodeposited diamond ring 13 is produced by attaching fine grains of diamond to the lower surface of the annular projection 12*a* and then plating the lower surface of the annular projection 12*a* with nickel for thereby fixing the fine grains of diamond with a plated nickel layer.

In operation, while the turntable 20 and the dresser 10 are rotated relatively to each other, and a dressing liquid such as pure water or an abrasive liquid is supplied from a nozzle (not shown) to a substantially central region of the polishing cloth 5, the lower surface of the electrodeposited diamond ring 13 is held against the upper surface of the polishing cloth 5 to scrape off a thin layer of the polishing cloth 5 for thereby dressing the polishing cloth 5.

The dresser body 12 has a diameter of 250 mm, and the electrodeposited diamond ring 13 on the lower end of the annular projection 12*a* has a radial width of 6 mm. As shown in FIG. 3A, the electrodeposited diamond ring 13 comprises a plurality of equal arcuate sectors (eight in the illustrated embodiment). The diameter of the dresser body 12 is greater than the diameter of the semiconductor wafer 2 to be polished. When the semiconductor wafer 2 is polished, therefore, the dressed surface of the polishing cloth 5 provides an extra margin with respect to the polished surface of the semiconductor wafer 2 in both radially inward and outward directions of the turntable 20. The dresser 10 may be replaced with an SiC dresser having a ring of sectors made of silicon carbide. The SiC dresser has a structure identical to the structure shown in FIGS. 3A–3C, and has on the surfaces of its sectors a number of pyramidal projections each having a height of about several tens of $\mu$m.

Figure 4:
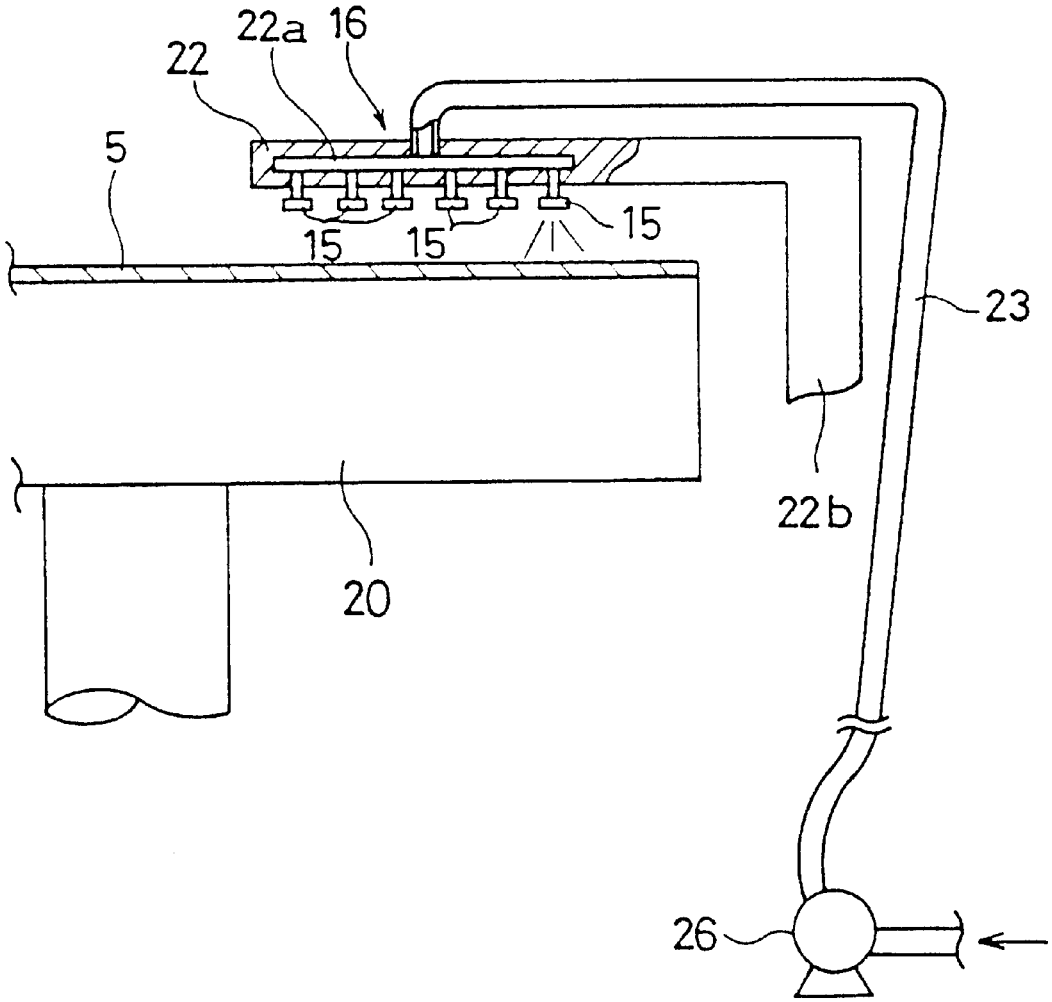
FIG. 4 is an elevational view of a second dressing unit comprising a fluid jet dresser incorporated in the polishing apparatus.

FIG. 4 shows structural details of the second dressing unit 16. As shown in FIG. 4, the second dressing unit 16 comprises an array of six water jet nozzles 15 positioned over the polishing cloth 5 and equally spaced radially of the polishing cloth 5. The water jet nozzles 15 are fixedly mounted on a water jet nozzle arm 22 having a liquid passage 22*a* defined therein. Pure water supplied from a pure water source (not shown) is pressurized by a pump 26 and supplied through a tube 23 and the liquid passage 22*a* to the water jet nozzles 15, from which pure water jets are ejected downwardly toward the polishing cloth 5.

The water jet nozzles 15 are positioned and oriented to apply the pure water jets ejected therefrom to an area of the polishing cloth 5 which is used to polish the semiconductor wafer 2, i.e., an area of the polishing cloth 5 against which the semiconductor wafer 2 is pressed so as to be polished. The water jet nozzle arm 22 is fixed in a position above the polishing cloth 5 by a vertical support 22*b*. However, the water jet nozzle arm 22 may be angularly movable in a horizontal plane about the vertical axis of the vertical support 22*b* for fine positional adjustment thereof and/or for standby position located radially outwardly of the polishing cloth 5 for maintenance thereof.

The pure water flowing through the water jet nozzle arm 22 is kept at a predetermined pressure by a controller (not shown) for the pump 26. The water jet nozzles 15 are identical in structure to each other, so that they eject respective water jets under substantially the same pressure at substantially the same rate. The pressure of the ejected water jets can be maintained in the range of 5 to 30 kg/cm$^2$ by controlling the pump 26.

When the polishing cloth 5 is dressed by the second dressing unit 16, the turntable 20 and hence the polishing cloth 5 are rotated to thereby apply the water jets ejected from the water jet nozzles 15 to the entire surface of the polishing cloth 5. Since the polishing cloth 5 is held in contact with the water jets for a period of time which is progressively shorter in the radially outward direction, the dressing effect on the polishing cloth 5 which is caused by the water jets may vary depending on the radial position on the polishing cloth 5. Therefore, in order to uniformize the dressing effect on the polishing cloth 5, the number of water jet nozzles 15 may be increased in the radially outward direction, or the water jet nozzles 15 may eject water jets at a progressively higher speed in the radially outward direction. Alternatively, the distance between the nozzle outlet and the polishing cloth 5 may vary from nozzle to nozzle. Further, the pressure and the speed at which the water jet is ejected may be made variable at each of the water jet nozzles 15.

Figure 5A:
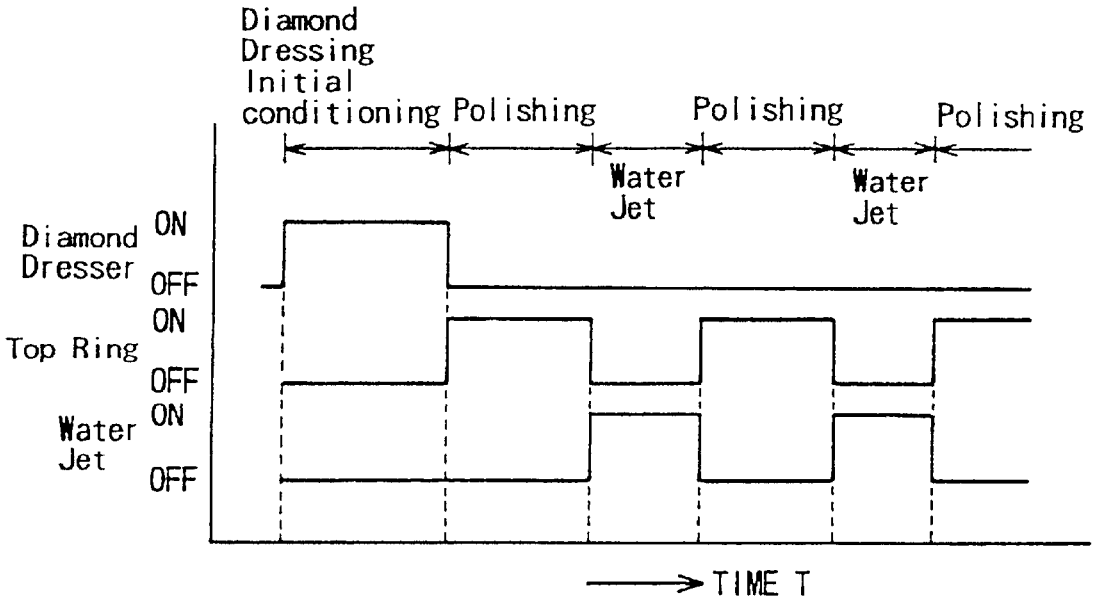
FIGS. 5A and 5B are timing charts of different patterns of polishing and dressing sequences carried out by the polishing apparatus.
Figure 5B:
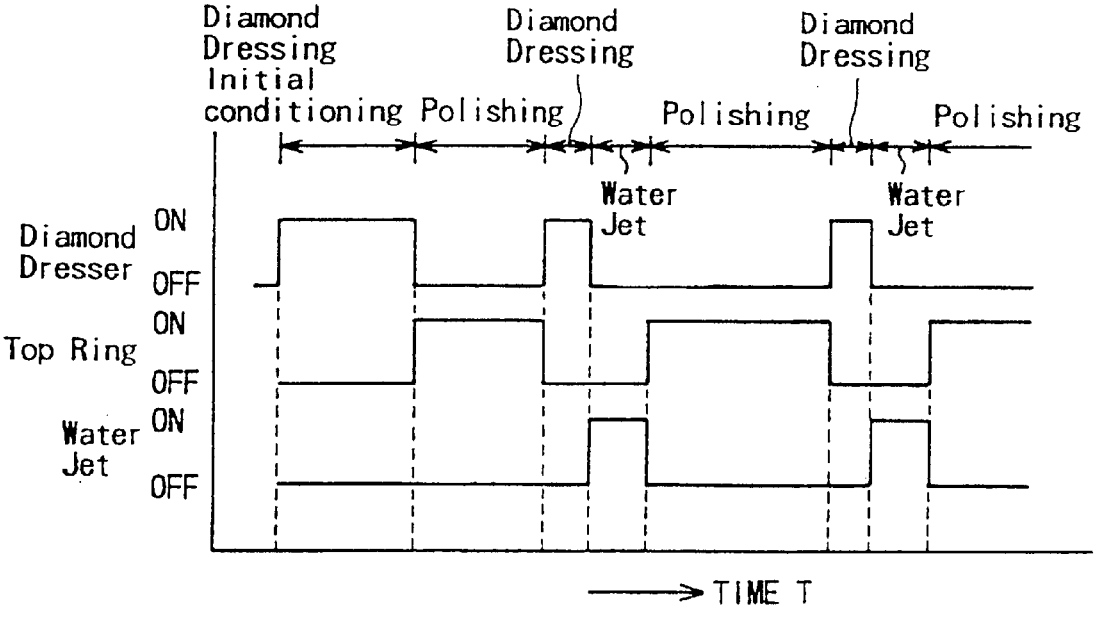

Polishing and dressing processes which are carried out by the polishing apparatus shown in FIGS. 1 through 4 will be described with reference to FIGS. 5A and 5B. FIGS. 5A and 5B are timing charts of different patterns of polishing and dressing sequences carried out by the polishing apparatus.

According to the pattern of polishing and dressing sequences shown in FIG. 5A, when the polishing cloth 5 starts to be used, it is first dressed by the diamond dresser 10 for initial conditioning. Thereafter, a semiconductor wafer 2 is polished using the dressed polishing cloth 5. Between polishing processes, the polishing cloth 5 is dressed by the water jet nozzles 15 with water jets ejected therefrom.

According to the pattern of polishing and dressing sequences shown in FIG. 5B, when the polishing cloth 5 starts to be used, it is first dressed by the diamond dresser 10 for initial conditioning. Thereafter, a semiconductor wafer 2 is polished using the dressed polishing cloth 5. Between polishing processes, the polishing cloth 5 is dressed in two steps, i.e., first by the diamond dresser 10 and then by the water jet nozzles 15 with water jets ejected therefrom.

As shown in FIGS. 5A and 5B, according to the polishing apparatus of the present invention, after initial conditioning of the polishing cloth 5 by the diamond dresser 10, polishing process of the semiconductor wafer is carried out, and after completing the polishing process, dressing of the polishing cloth 5 by the wafer jet is carried out. Thereafter, polishing process is carried out again. Further, between polishing processes, dressing of the polishing cloth 5 by the diamond dresser and the water jet may be combined.

In the illustrated embodiment, the contact-type dresser of the first dressing unit 11 comprises the diamond dresser 10. However, the diamond dresser may be replaced with a brush dresser. Furthermore, pure water is used as the dressing liquid in the first dressing unit 11 and also as water jets in the second dressing unit 16. However, chemicals such as alkaline liquid or surface-active agent may be used in the first and second dressing units 11 and 16 for performing a chemical dressing action in addition to a mechanical dressing action.

In as much as the polishing apparatus according to the present invention is equipped with both the first dressing unit 11 having the contact-type dresser comprising the diamond dresser 10 and the second dressing unit 16 having the noncontact-type dresser comprising the water jet nozzles 15, it is not necessary to replace two dressing units unlike the conventional polishing apparatus, and the two dressing units 11, 16 may be combined to carry out a desired pattern of dressing processes. If the polishing apparatus is applied to the fabrication of semiconductor devices, then semiconductor devices can be manufactured in a high yield with high productivity.

Although a certain preferred embodiment of the present invention has been shown and described in detail, it should be understood that various changes and modifications may be made therein without departing from, the scope of the appended claims.

INDUSTRIAL APPLICABILITY

The present invention relates to a polishing apparatus for polishing a workpiece such as a semiconductor wafer to a planar finish, and is preferably utilized in manufacturing semiconductor devices.

What is claimed is:

1. A method of conditioning a polishing cloth attached to a turntable for polishing a workpiece, said method comprising:

dressing the polishing cloth with a first dressing unit having a contact-type dresser as an initial conditioning before the polishing cloth is used for polishing; and dressing the polishing cloth with a second dressing unit having a noncontact-type dresser between polishing processes, each for polishing a workpiece, wherein the second dressing unit comprises a plurality of water jet nozzles which are positioned radially over the polishing cloth, and water jets are ejected from the plurality of water jet nozzles at a progressively higher speed or pressure in a radially outward direction from a center of the polishing cloth.

2. A method according to claim 1, wherein the contact-type dresser comprises one of a diamond dresser and an SiC dresser.

3. A method according to claim 1, wherein the noncontact-type dresser comprises a fluid jet nozzle for ejecting a fluid jet.

4. A method of conditioning a polishing cloth attached to a turntable for polishing a workpiece, said method comprising:

dressing the polishing cloth with a first dressing unit having a contact-type dresser as an initial conditioning before the polishing cloth is used for polishing; and dressing the polishing cloth first with the first dressing unit and then with a second dressing unit having a noncontact-type dresser between polishing processes, each for polishing a workpiece, wherein the second dressing unit comprises a plurality of water jet nozzles which are positioned radially over the polishing cloth, and water jets are ejected from the plurality of water jet nozzles at a progressively higher speed or pressure in a radially outward direction from a center of the polishing cloth.

5. A method according to claim 4, wherein the contact-type dresser comprises one of a diamond dresser and an SiC dresser.

6. A polishing apparatus comprising:

a turntable with a polishing cloth attached thereto;

a top ring being operable to hold and press a workpiece to be polished against said polishing cloth under a certain pressure;

a first dressing unit having a contact-type dresser, said first dressing unit being operable to dress said polishing cloth by bringing said contact-type dresser in contact with said polishing cloth; and a second dressing unit having a noncontact-type dresser, said second dressing unit being operable to dress said polishing cloth, wherein said noncontact-type dresser comprises a plurality of water jet nozzles which are positioned radially over said polishing cloth, and said plurality of water jet nozzles are operable to eject water jets at a progressively higher speed or pressure in a radially outward direction from a center of said polishing cloth.

7. A polishing apparatus according to claim 6, wherein said contact-type dresser comprises one of a diamond dresser and an SiC dresser.

8. A polishing apparatus according to claim 6, wherein each of the water jets has a pressure ranging from 5 to 30 $kg/cm^2$.

9. A polishing apparatus according to claim 6, further comprising a water jet nozzle arm, wherein said plurality of water jet nozzles are mounted on said water jet nozzle arm, and said water jet nozzle arm is movable to a standby position located radially outward of said polishing cloth.

10. A polishing apparatus comprising:

a turntable with a polishing cloth attached thereto;

a top ring being operable to hold and press a workpiece to be polished against said polishing cloth under a certain pressure;

a first dressing unit having a contact-type dresser, said first dressing unit being operable to dress said polishing cloth by bringing said contact-type dresser in contact with said polishing cloth; and a second dressing unit comprising a noncontact-type dresser, said noncontact-type dresser having a plurality of water jet nozzles which are positioned radially over said polishing cloth;

wherein the number of said water jet nozzles positioned over a central area of said polishing cloth is less than that of said water jet nozzles positioned over a peripheral area of said polishing cloth.

11. A polishing apparatus comprising:

a polishing cloth to polish a workpiece;

a top ring being operable to hold and press said workpiece to be polished against said polishing cloth under a certain pressure;

a first dressing unit having a contact-type dresser, said first dressing unit being operable to dress said polishing cloth by bringing said contact-type dresser in contact with said polishing cloth; and a second dressing unit comprising a noncontact-type dresser, said noncontact-type dresser having a plurality of water jet nozzles which are positioned radially over said polishing cloth;

wherein the distance between a nozzle outlet of each of said water jet nozzles and said polishing cloth is different from each other.

* * * * *